United States Patent [19]

Stern et al.

[11] Patent Number: 4,795,211

[45] Date of Patent: Jan. 3, 1989

[54] UNIVERSAL CONTAINER HOLDER

[75] Inventors: Jon L. Stern, Beverly Hill; Richard S. Katz, Jr., Los Angeles; Keith A. Hippely, Manhattan Beach, all of Calif.

[73] Assignee: Cine Coasters, Inc., Los Angeles, Calif.

[21] Appl. No.: 131,658

[22] Filed: Dec. 11, 1987

[51] Int. Cl.[4] ..... A47C 7/62

[52] U.S. Cl. ..... 297/194; 297/411; 248/311.2

[58] Field of Search ..... 217/194, 411, 416, 145; 248/118, 311.2

[56] References Cited

U.S. PATENT DOCUMENTS

| | | | |
|---|---|---|---|
| 1,869,444 | 8/1932 | Tobey | 297/145 |
| 2,649,270 | 8/1953 | Franks . | |
| 2,721,718 | 10/1955 | Wagner | 248/311.2 X |
| 2,754,078 | 7/1956 | Koger et al. . | |
| 2,903,225 | 9/1959 | Weinstein . | |
| 3,215,467 | 11/1965 | McFarland et al. . | |
| 3,233,858 | 2/1966 | Benjamin . | |
| 3,233,940 | 2/1966 | Tooley, Jr. . | |
| 3,472,241 | 10/1969 | Gielow et al. . | |
| 3,532,318 | 10/1970 | Lloyd | 248/311.2 |
| 3,637,184 | 1/1972 | O'Brien . | |
| 3,675,969 | 7/1972 | Gage . | |
| 3,690,724 | 9/1972 | Douglas et al. . | |
| 3,807,319 | 4/1974 | Steanson, Jr. . | |
| 3,913,878 | 10/1975 | Wayne | 248/311.2 |
| 3,994,465 | 11/1976 | Rudnitzky . | |
| 4,262,962 | 4/1981 | Yust . | |
| 4,417,764 | 11/1983 | Marcus et al. . | |
| 4,434,961 | 3/1984 | Hoye . | |
| 4,548,326 | 10/1985 | Danna et al. . | |

FOREIGN PATENT DOCUMENTS

| | | | |
|---|---|---|---|
| 2521750 | 11/1974 | Fed. Rep. of Germany | 248/311.2 |
| 191515 | 9/1937 | Switzerland | 297/414 |
| 956414 | 4/1964 | United Kingdom | 297/416 |

*Primary Examiner*—Kenneth J. Dorner
*Assistant Examiner*—Laurie K. Cranmer
*Attorney, Agent, or Firm*—Fulwider, Patton, Rieber, Lee & Utecht

[57] ABSTRACT

A universal container holder for attachment to stadium or theater seats. A downwardly open armrest portion is adapted to fit over the seat armrest to project a container holder portion beyond the front of the armrest for holding different sizes of containers. Adhesive material or adjustable clamp members enable mounting of the container holder to various sizes and configurations of armrests.

10 Claims, 2 Drawing Sheets

UNIVERSAL CONTAINER HOLDER

TECHNICAL FIELD

The present invention relates to a universal container holder for attachment to stadium or theater seats, and particularly to a universal container holder adapted to fit over various sizes and configurations of seat armrests without physically altering the armrest.

BACKGROUND ART

In the crowded confines of stadiums or theaters it is impractical to balance a beverage container on the armrest of the seat or to place it on the floor since it is likely to be knocked over. Even if carefully balanced on the armrest, the occupant is deprived of the use of the armrest. Alternatively, it is awkward and tiring to hand hold the container during the course of a game or performance.

A number of trays or holders are available in the prior art to support one or more containers for holding beverages, popcorn, etc. They are especially tailored for a predetermined or standard style of armrest structure and are not easily adapted for use with other sizes and configurations of armrests. Moreover, they are too easily removable from the armrest so that they can be stolen or vandalized. For example, U.S. Pat. No. 4,262,962, for "Stadium Seat Arm Gripping Tray", is designed for a standard stadium seat armrest structure, and particularly a T-shaped armrest characterized by a vertical section surmounted by a horizontal section having laterally directed portions. The tray includes openings for supporting cups or containers. The tray further includes a mounting portion having a T-slot for longitudinally slidably fitting the mounting portion over the T-shaped armrest. By reason of this construction the tray is unfortunately easily separable from the armrest by simply pulling it outwardly, and its predetermined configuration enables its use with only one size and configuration of armrest.

Another representative device of the prior art is disclosed in U.S. Pat. No. 4,548,326 for "Stadium Seat Arm Gripping Tray". This device is characterized by an arm portion for attachment to the seat armrest, and by an integral tray portion having a pair of recesses for containers. The arm portion includes depending side walls which incorporate spring fingers precisely dimensioned to snap onto a complementally dimensioned and configured armrest structure. The device is easily upwardly separable from the armrest simply by gripping one or both of the side walls and pulling them outwardly and upwardly. Another container supporting device is shown in U.S. Pat. No. 3,675,969 for "Chair-Arm Cup Receptacle". It has the virtue of not being easily removable, but it is attached in position above the armrest by screws which pass through flexible tabs of the receptacle and into the arm of the chair. Consequently, the armrest is defaced, and the device itself projects some distance above the level of the chair arm.

DISCLOSURE OF THE INVENTION

According to the present invention, a universal container holder is provided which is semi-permanently mounted to a stadium or theater armrest without defacing or marring the armrest. It includes an armrest recess defined by a generally flat upper wall which rests on the armrest, and further includes a pair of side walls and a rear wall depending from the upper wall. The walls fit over and protect the armrest from beverage spills and conceal soiled, worn or paint chipped armrests. Since the rear wall overlies the inner end o the armrest, the holder cannot be separated from the armrest by pulling it longitudinally outwardly.

The flat upper surface of the holder provides an armrest surface at approximately the same height as the seat armrest.

The holder includes a container holder portion integral with and forming an outward or forward continuation of the side walls of the armrest portion. This projects the container holder portion beyond the front of the armrest so that the support of containers does not interfere with use of the device as an armrest The projected portion is smoothly rounded to prevent the clothing of passing patrons from catching on it. In addition, the container holding portion is of universal character, including concentric, vertically arranged cylindrical walls of different diameters which form annular ledges at different heights to support different sizes of container.

Two versions of attachment or mounting are provided. One system employs a pair of clamp members which are urged against the underside of the armrest by fasteners passing through the clamp members and into the underside of the armrest portion of the holder. The armrest is gripped between the clamp members and the upper wall of the holder, enabling the holder to be attached to armrests of different thicknesses and widths. The clamping arrangement is positive and it is not possible to separate the holder from the armrest without the aid of a screwdriver or the like.

The clamp members are preferably constrained against longitudinal and lateral movement relative to the armrest portion by interengagement with vertical supports integral with the armrest portion.

An alternative mounting system comprises means adhesive means carried on the underside of the armrest portion for adherence to the upper surface of the seat armrest, or for adherence to a protective sleeve previously fitted to the armrest. The adhesive is quite tenacious and separation of the holder from the armrest cannot be achieved without the application of a very considerable upward force. Like the clamp member embodiment, the adhesive version includes the depending rear wall which is engagable with the rear of the armrest to prevent outward and longitudinal separation of the holder from the armrest.

The foregoing arrangement provides universal attachment of the holder to various sizes and configurations of armrests, the and universal acceptance of a variety of different sizes of cups or containers.

Other objects and features of the invention will become apparent from consideration of the following description taken in connection with the accompanying drawings.

BEST MODES FOR CARRYING OUT THE INVENTION

Figure 1:
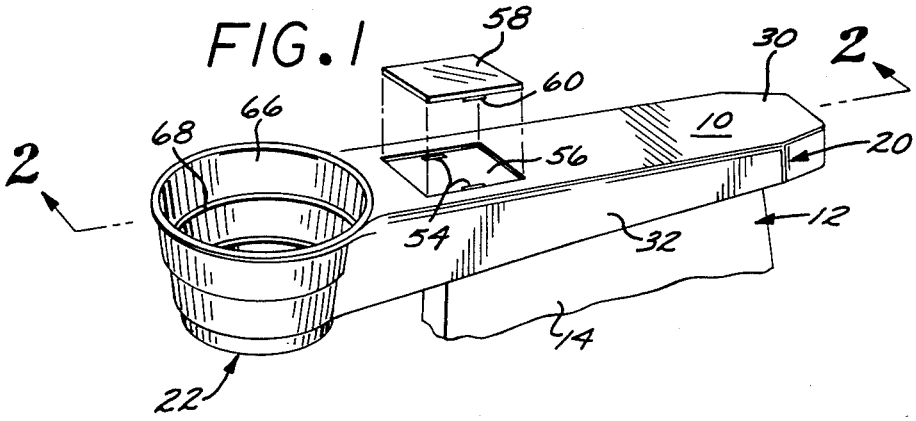
FIG. 1 is a perspective view of the present universal container holder mounted to the armrest of a stadium or theater seat.
Figure 2:
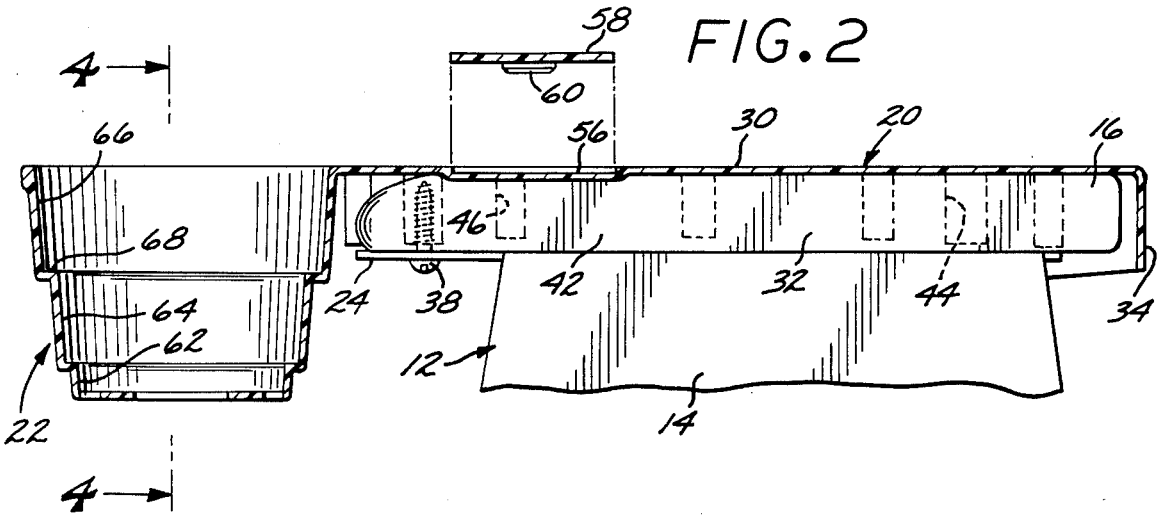
FIG. 2 is an enlarged view taken along the line 2—2 of FIG. 1
Figure 5:
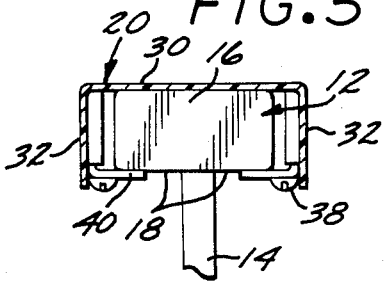
FIG. 5 a partial vertical cross sectional view of the holder of FIG. 1.

Referring now to the drawings, and particularly to FIG. 1, a universal container holder 10 according to the present invention is illustrated as it would appear when mounted or attached to the armrest 12 of a stadium or theater seat. Although the armrest may take different forms, it is typically characterized by a T-section, as illustrated in FIG. 5. The T-shape is defined by a vertical section 14 surmounted by a horizontal section 16 extending laterally on either side of the vertical section and forming undersides 18 which facilitate mounting of the holder in position upon the armrest, as will be seen.

As best seen in FIGS. 1–3 and 6, the holder 10 comprises, generally, an armrest portion 20 which rests on top of the armrest 12, a container holder portion 22 integral with and forming an outward or forward continuation of the armrest portion. In one embodiment a pair of clamp members 24 engage the armrest undersides 18 to fix the holder to the armrest. In another embodiment an adhesive strip 26 carried by the underside of the armrest portion is adherable either to the upper surface of the armrest itself, or to an elongated removable sleeve 28, as seen in FIG. 7.

Preferably the armrest and container holder portions of the holder 10 are made of a suitable high impact plastic material capable of withstanding rugged abuse, resistant to stains and marring, and relatively light in weight and easy to mold or otherwise fabricate. A number of suitable plastic materials of this character are available on the market and a description of such materials is omitted for brevity.

The armrest portion 20 comprises a generally flat upper wall 30 which serves as an armrest when the holder is in position upon the original armrest 12. The portion 20 also comprises a pair of side walls 32 and a rear wall 34 integral with and depending from the upper wall to complementally fit over the sides and inner end of the armrest 12. This arrangement aesthetically conceals and protects the armrest 12 against beverage spills, and improves the appearance of worn, chipped and defaced armrests. In all embodiments of the present holder the rear wall 34 is adapted to engage the rear of the armrest to prevent the holder from being outwardly, longitudinally separated from the armrest 12.

Figure 3:
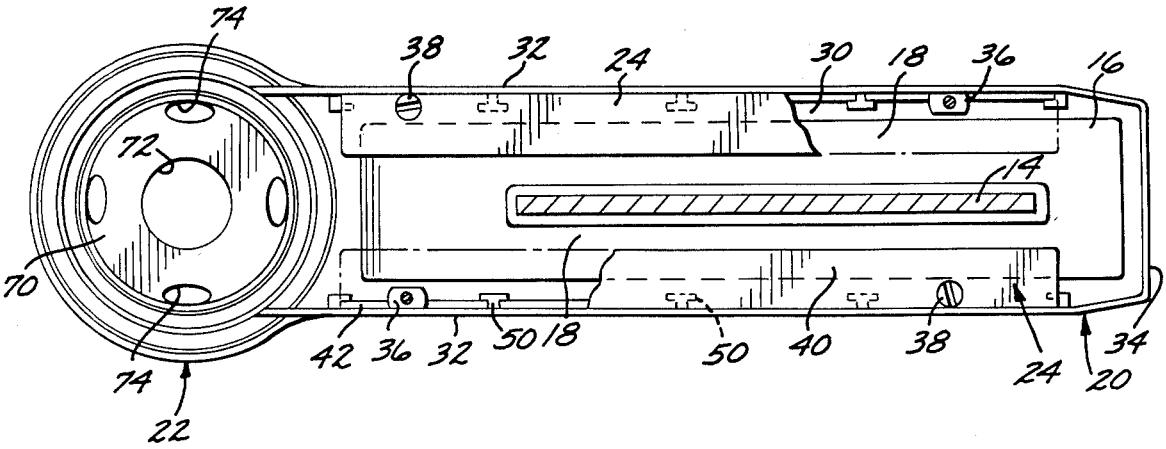
FIG. 3 bottom plan view of the holder of FIG. 2.
Figure 6:
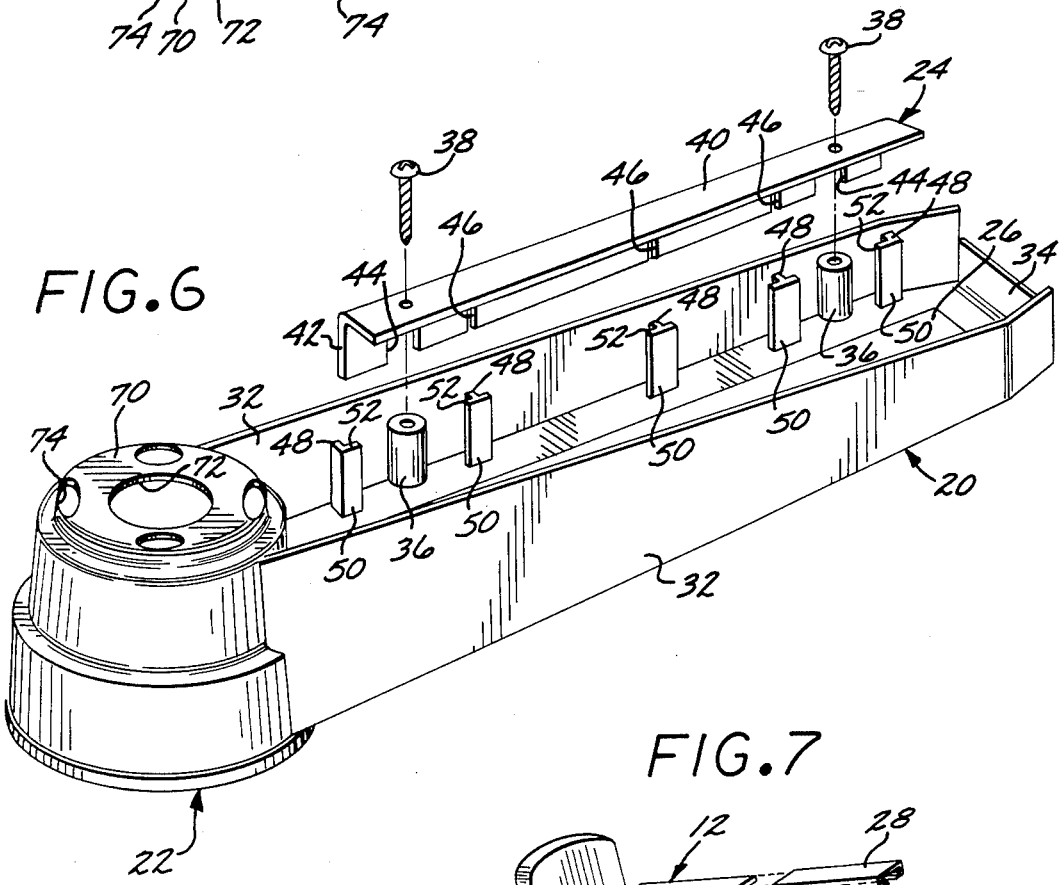
FIG. 6 an enlarged perspective view of the underside of the holder of FIG. 1, illustrating the manner of mounting of one of the clamping members and also illustrating the position of the adhesive strip used in the alternate mounting arrangement.
Figure 7:
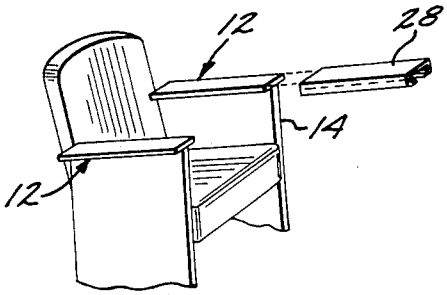
FIG. 7 is a perspective view of a theater or stadium seat illustrating a form of sleeve which can be mounted on the seat armrest to provide a surface for adhesive mounting of the holder.

As best seen in FIGS. 3 and 6, the underside of the armrest portion upper wall 30 preferably includes a plurality of centrally apertured vertical posts 36 which are adapted to receive the shanks of a corresponding plurality of fasteners 38 to clamp the holder onto the armrest 12. Any suitable fasteners 38 can be used for this purpose, the version illustrated having a slotted head for rotation by a screwdriver, and further having a shank which may be either threaded or provided with sheet metal type grooves for self-threading or cutting into the walls of the post apertures. The fasteners 38 pass through suitable openings in each horizontal leg 40 of the right angular clamp members 24. The other or vertical leg 42 of each clamp member includes a plurality of vertical slots 44 and 46. When the clamp members 24 are in mounted position, the vertical leg 42 of each clamp member rests against the inner surface of the adjacent holder side wall 32, the purpose of the slots 44 being to accommodate the vertical posts 36. The purpose of the slots 46 is to vertically slidably fit over the inner webs 48 of a plurality of vertical supports 50 which, like the vertical posts 36, are integrally molded to the adjacent walls of the armrest 20.

When the clamp members are in operative position, the edge margins of the slots 46 bear against the inner surfaces of flanges 52 which are integral with the supports 50 and extend laterally of the webs 48. With this arrangement the clamp members 24 are constrained against both inward and longitudinal movement relative to the armrest portion 20. This securely anchors the holder 10 in position upon the armrest 12 regardless of the vertical thickness or horizontal width of the armrest 12, as best seen in FIG. 5. If the armrest 12 is thicker than that illustrated, the clamp members 24 would be located somewhat lower and longer fasteners 38 would be used. It can also be seen that the horizontal legs 40 of the clamp members are wide enough to fit beneath and clamp against the undersides 18 of various widths of armrest. Consequently, the clamp embodiment of the present holder is of universal character, being adapted to fit over and clamp upon various sizes and configurations of armrest, so long as the armrest is characterized by an armrest horizontal section having laterally directed portions wider than the vertical section which supports the horizontal section.

In the adhesively mounted embodiment of the holder, the strip 26 is preferably adhesively coated on one side for attachment to the underside of the armrest portion 20, as seen in FIG. 6, while the other side, which is also adhesively coated, carries a thin layer of protective plastic film (not shown), which can easily be stripped away just prior to mounting of the holder onto the armrest. Such double sided adhesive tape is well known in the art. The same armrest portion 20 is thus adapted to be mounted to the armrest by either the clamp members 46 or by the adhesive strip 26.

The strip 26 can either be brought into contact directly with the upper surface of the horizontal section 16 of the armrest or, if the armrest is upholstered or otherwise unsuitable for such an attachment, the sleeve 28 is used. As seen in FIG. 7, the sleeve is rectangular in transverse cross section and includes a slot in its underside to enable the sleeve 28 to be longitudinally slidably fitted over the armrest 12, with the vertical section 14 being received within the slot. The sleeve 28 then provides the surface onto which the adhesive strip 26 is positioned. Like the clamp member embodiment, the mounted holder cannot be longitudinally slidably demounted from the armrest 12 because the rear wall 34 will engage the rear of the armrest and prevent such removal. Consequently, removal is only possible by upwardly pulling with sufficient force to break the adhesive bond between the holder and the armrest, and adhesives are available which are extremely tenacious to discourage such separation.

If desired, the upper wall of the armrest portion 20 may be provided with one or more slots 54 within a generally square depressed area or recess 56. The recess is adapted to complementally receive a transparent insert plate 58 in flush relation with the adjacent upper surface of the upper wall 30. The plate 58 includes a pair of integral resilient fingers or projections 60 adapted to be press fitted through the slots 54 for biasing against the margins of the slots 54 to removably secure the plate 58 in position. The arrangement permits advertising material, team insignia, etc. to be disposed beneath the plate 58 where it can be seen by the seat occupant and passers-by.

The container holder portion 22 is an outward or forward continuation of the armrest side walls 32, projecting beyond the front of the armrest so that the upper wall of the armrest portion is made available for use as an armrest surface. The container holder portion is generally cylindrical in configuration, presenting smoothly rounded surfaces not susceptible to catching upon the clothing of passers-by.

Figure 4:
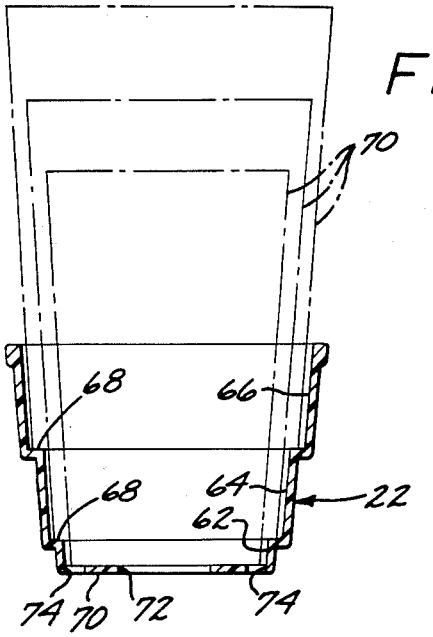
FIG. 4 view taken along the line 4—4 of FIG. 2.

The container holder portion is characterized by a plurality of concentric, vertically arranged cylindrical walls 62, 64 and 66 which are each smaller than the one above it to define annular ledges 68 adapted to support containers of different sizes, respectively. The containers are shown in phantom outline at 70 in FIG. 4. The lowermost cylindrical wall terminates in a base 70 adapted to support the smallest of the containers 70. It is characterized by a central opening 72 and a plurality of circumferentially arranged elongate openings 74, all of which serve as drainage openings for spillage from the containers 70.

The upper circular margins of the cylindrical wall 66 preferably form a smooth continuation or outward terminus of the upper surface of the upper wall 30 of the armrest portion 20 so that no obstruction is presented to the occupant's use of the armrest portion when there are no containers 70 in the container holder portion 22.

Thus, the present universal container holder is adapted to be semi-permanently mounted to a stadium or theater armrest without any necessity for defacing or marring the armrest. The walls of the holder fit over and protect and conceal the armrest, and the rear wall of the holder prevents any outward longitudinal separation of the holder from the armrest. The holder not only provides an armrest surface at approximately the same height as the original seat armrest, but it includes a flush, forward continuation or container holder portion adapted to hold containers of various sizes. Both the clamp mounted and adhesive mounted versions of the holder are adaptable for association with a variety of sizes and configurations of stadium or theater armrests.

Various modifications and changes may be made with regard to the foregoing detailed description without departing from the spirit of the invention.

We claim:

1. A universal container holder for attachment to the armrest of a stadium or theatre seat, wherein the armrest is characterized by a vertical section surmounted by a horizontal section extending laterally on either side of the vertical section, the support holder comprising:

an armrest portion having a generally flat upper wall for service as an armrest, and a pair of side walls and a rear wall depending from the upper wall to fit over the sides and inner end of the armrest, the upper wall including vertical post means adjacent the side walls for receiving fasteners which hold a pair of clamp members against the undersides of the armrest horizontal section and prevent separation of the armrest portion from the armrest; and a container holder portion integral with and forming an outward continuation of the side walls projecting beyond the front of the armrest, the container holder portion including concentric, vertically arranged cylindrical walls which are each smaller in diameter than the one above it to define annular ledge means for supporting containers of different sizes, respectively.

2. A universal container holder according to claim 1 wherein the clamp members include a pair of angle brackets which are each characterized by a vertical leg fitting between an adjacent one of the side walls and the associated posts, and a horizontal leg adapted to engage the undersides of the armrest horizontal section.

3. A universal container holder according to claim 2 wherein the side walls include vertical supports which each have an inner web extending from the associated side wall and terminating in oppositely directed flanges, and wherein the angle brackets include vertical slots slidable over the inner webs, respectively, for constraining the angle brackets against longitudinal and lateral movement.

4. A universal container holder according to claim 1 wherein the upper surface of the upper wall of the armrest portion includes a slot and a recessed area surrounding the slot, and including a transparent insert plate adapted to complementally fit within the recessed area in flush relation with the upper surface of the upper wall, the insert plate including an integral resilient projection adapted to fit within the slot and engage an edge margin of the slot for retention of the insert plate within the recess.

5. A universal container holder according to claim 1 wherein the lowermost cylindrical wall terminates in a base having drainage apertures.

6. A universal container holder for attachment to the armrest of a stadium or theatre seat, wherein the armrest is characterized by a vertical section surmounted by a horizontal section extending laterally on either side of the vertical section, the support holder comprising:

an armrest portion having a generally flat upper wall for service as an armrest, and a pair of side walls and a rear wall depending from the upper wall to fit over the sides and inner end of the armrest;

a container holder portion integral with and forming an outward continuation of the side walls projecting beyond the front of the armrest, the container holder portion including concentric, vertically arranged cylindrical walls which are each smaller in diameter than the one above it to define annular ledge means for supporting containers of different sizes, respectively;

an elongated sleeve means having a downwardly open slot for slidable positioning of the sleeve onto the armrest;

and further including adhesive means disposed on the underside of the upper wall for adherence to the sleeve means.

7. In combination with the armrest of a stadium or theater seat in which the armrest is characterized by a vertical section surmounted by a horizontal section extending laterally on either side of the vertical section, an improved universal container holder comprising:

an armrest portion including a generally flat upper wall having an undersurface engaged upon the upper surface of the armrest horizontal section, and having an upper surface for use as an armrest surface, and having centrally apertured vertical posts, the armrest portion further including a pair of side walls and an end wall depending from the upper wall and overlying the sides and inner end of the armrest, the side walls including vertical supports which each have an inner web extending from the associated side wall and terminating in oppositely directed flanges;

a pair of angle brackets each characterized by a horizontal leg engaging the underside of the armrest horizontal section, and by a vertical leg having vertical slots which receive, respectively, the inner webs of the vertical supports, with the webs and the oppositely directed flanges constraining the angle brackets against longitudinal and lateral movement;

a plurality of fasteners passing through the horizontal legs and into the apertured vertical posts and clamping the angle brackets against the armrest and preventing separation of the armrest portion from the armrest; and a container holder portion integral with the armrest portion and having cylindrical walls forming a smoothly rounded outward continuation of the armrest portion projecting beyond the front of the armrest, the cylindrical walls defining a relatively large diameter first recess for supporting a container, the first recess having inner edge margins defined by the outward terminus of the upper wall of the armrest portion, the cylindrical walls further defining successively lesser diameter recesses below the first recess for supporting lesser diameter containers, the lowermost cylindrical wall terminating in a base having drainage apertures.

8. A universal container holder according to claim 7 wherein the upper surface of the upper wall of the armrest portion includes a slot and a recessed area surrounding the slot, and including a transparent insert plate adapted to complementally fit within the recessed area in flush relation with the upper surface of the upper wall, the insert plate including an integral resilient projection adapted to fit within the slot and engage an edge margin of the slot for retention of the insert plate within the recess

9. In combination with the armrest of a stadium or theater seat in which the armrest is characterized by a vertical section surmounted by a horizontal section extending laterally on either side of the vertical section, an improved universal container holder comprising:

an elongated sleeve fitted over the horizontal section and having a downwardly open slot receiving the vertical section;

an armrest portion including a generally flat upper wall having an undersurface carrying adhesive means adhered to the upper surface of the sleeve, the upper wall having an upper surface for use as an armrest surface, the armrest portion further including a pair of side walls and an end wall depending from the upper wall and overlying the sides and inner end of the armrest; and a container holder portion integral with the armrest portion and having cylindrical walls forming a smoothly rounded outward continuation of the armrest portion projecting beyond the front of the armrest, the cylindrical walls defining a relatively large diameter first recess for supporting a container, the first recess having inner edge margins defined by the outward terminus of the upper wall of the armrest portion, the cylindrical walls further defining successively lesser diameter recesses below the first recess for supporting lesser diameter containers, the lowermost cylindrical wall terminating in a base having drainage apertures.

10. A universal container holder according to claim 9 wherein the upper surface of the upper wall of the armrest portion includes a slot and a recessed area surrounding the slot, and including a transparent insert plate adapted to complementally fit within the recessed area in flush relation with the upper surface of the upper wall, the insert plate including an integral resilient projection adapted to fit within the slot and engage an edge margin of the slot for retention of the insert plate within the recess.

* * * * *